United States Patent [19]

Stevens

[11] 4,073,017

[45] Feb. 14, 1978

[54] PORTABLE PLAYPEN

[76] Inventor: Amy L. Stevens, 1616 York Drive, Vista, Calif. 92083

[21] Appl. No.: 735,795

[22] Filed: Oct. 26, 1976

[51] Int. Cl.[2] ..... A47C 29/00

[52] U.S. Cl. ..... 5/97; 5/98 R; 5/99 B

[58] Field of Search ..... 5/97 R, 98 R, 99 R; 256/25, 26, 30, 31

[56] References Cited

U.S. PATENT DOCUMENTS

| | | | |
|---|---|---|---|
| 1,669,484 | 5/1928 | Mowry | 256/25 |
| 2,097,506 | 11/1937 | Auty | 5/99 C |
| 2,646,576 | 7/1953 | Abrams | 5/99 B |
| 2,958,084 | 11/1960 | Kenney | 5/99 R |
| 3,018,493 | 1/1962 | Witterbrodt | 5/99 R |
| 3,924,280 | 12/1975 | Vaiano | 5/98 R |
| 3,973,280 | 8/1976 | Mathou | 5/99 B |

*Primary Examiner*—Casmir A. Nunberg
*Attorney, Agent, or Firm*—Duane C. Bowen

[57] ABSTRACT

A portable playpen adapted particularly for backpacking and other camping and to be raised from the ground. A fabric enclosure, partly made of netting, with side and bottom walls; four posts in the corners, set in the ground; four bars supporting the side walls and secured to the posts; four guys extending from the top of the posts and tied to stakes at outlying locations; a folding floor; and a netting top. The assembly fitting in a bag for carrying and storage.

8 Claims, 7 Drawing Figures

21
23
50
59
16
52
46
12
42
14
25
27
18
51
66
60
62
64
20
22
40
39
32
44
24
10
34
30
36

PORTABLE PLAYPEN

SUMMARY OF THE INVENTION

My invention relates to a portable playpen adapted particularly for backpacking and other camping.

Parents with a young child of the age in which playpens are used would particularly like to have a playpen to minimize care of the child at times, to provide a safe and sanitary play area, to keep the child from straying, to keep the child away from dangerous locations, etc. In the past it has often been impractical to provide a playpen in camping situations in general as space often is not available in the vehicle used for transportation for the usual quite bulky and heavy playpen even in folded condition. It is an objective of my invention to provide a playpen that may be transported in a minimum size and weight package for general camping usage. From the later description it will be obvious that a readily transportable, minimum bulk playpen would have use also in visits to urban parks or the like, in home yards, etc.

Size and weight are of critical importance in backpacking. Parents with a young child may desire to take a backpacking trip away from camp sites but no playpen is known that could be carried in backpacking, as a practical matter, even if the size and weight were not a problem in vehicle transportation to the area. It is an additional objective of my invention to provide a playpen which is practical from size, weight and other considerations, to be used in backpacking.

It should be noted in camping in general and backpacking in particular that the site where it is desired to use the playpen may be too uneven or irregular for convenient support of a conventional playpen, which usually is constructed for support on four casters or legs on a flat supporting surface like a floor. A further objective of my invention is to provide corner post playpen support in which the posts are set in the ground so that there is adaptability for use of the playpen on sites which have some irregularity or slope.

Additional objectives of my invention include: to provide such a playpen of economical but rugged construction; to devise such a playpen that may be raised with minimum time but is suitably strong and stable; to provide such a playpen that may be disassembled to a minimum sized package for carrying, transportation and storage; to provide a minimum sized bag to contain such components during transportation and carrying; to provide a netting top that can be installed when it is desired to protect a child from mosquitoes, flies and other insects; and to provide a separate floor which can be left behind when hiking considerable distance in backpacking.

My invention will be best understood, along with additional advantages and objectives thereof, from the following description, read with reference to the drawings.

DRAWINGS

DESCRIPTION

Figure 1:
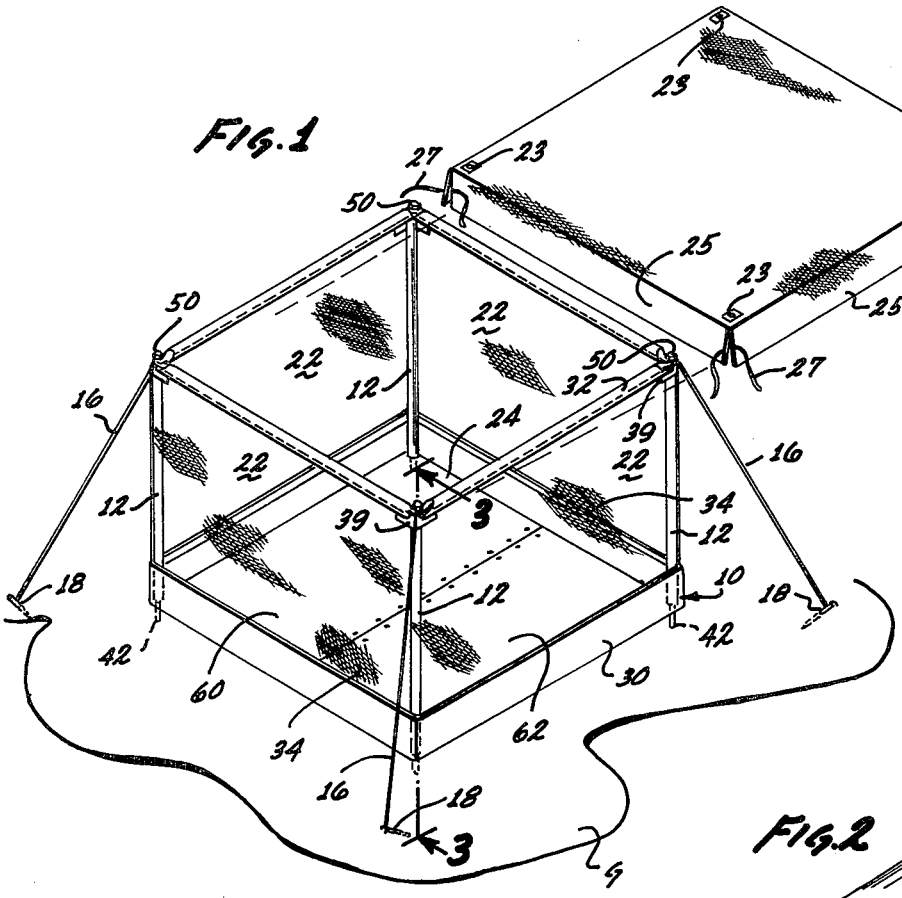
FIG. 1 is a perspective view of a specific embodiment of my portable playpen raised on the ground.

As above indicated, my objective was to provide a playpen that could be carried in backpack camping. Parents with a young child will not engage in as strenuous backpacking trips as they might if they didn't have a young child but such parents do make backpacking trips suitable for the circumstances. A backpacking trip generally means hicking from where a vehicle is parked to a location not accessible with the vehicle. Usually the location can be called a wilderness area and will not be developed for camping, i.e., everything needed will have to be carried in backpacks or will have to be otherwise carried, whether the distance is two miles or twenty or more miles from the vehicle. The hikers may change location from day to day or from time to time. For a playpen to be carried on such a backpacking trip, it must be light, it must be compact and suitably packed for carrying, it must be adapted to be raised on the sort of sites that can be found in backpacking which may have some slope and unevenness, and it must be suitably priced.

My playpen assembly meets the above requirements and includes a fabric member enclosure 10, four upright posts 12, four horizontal top bars 14, four guys 16, four stakes 18 for guys 16, a folding floor 20, and a top 21.

Member 10 is termed a "fabric member enclosure". The word "fabric" is to be taken in its general sense as meaning cloth which is woven, knitted, etc., from natural or artificial fibers, or any similar material, whether having the form of netting or closed fabric. By the words "similar material" I mean to include pliable sheet materials that may or may not be woven such as plastic materials, i.e., plastic films or nonwoven plastic fabrics. The selection of a material is merely a question of picking the best pliable sheet material considering matters such as suitability for the application, durability, and economy.

Fabric member enclosure 10 is formed with four side walls 22 and a bottom wall 24 in generally right-rectangular disposition. The enclosure can have an open top, particularly for a standing child, but a baby or a sleeping child usually will be protected by a mosquito netting top 21 for camping in locations where mosquitoes, flies or other bugs are a problem. To match use of the protective top 21, the netting on the side walls 22 also should be fine enough to bar mosquitoes. Mosquito netting top 21 has corner grommets 23 which fit on post upper studs 46, depending side walls 25 to lap the upper portions of enclosure side walls 22, and fabric ties 27 paired in each corner to tie together the lower margins of depending side walls 25.

In the preferred construction shown, closed fabric material is used for bottom wall 24 and for the lower and upper portions 30, 32 of side walls 22, and a netting is used for the vertically intermediate and major portion 34 of side walls 22. By "major portion" I mean more than half of the vertical height of side walls 22. By "closed fabric" I mean that the fibers are spaced closely enough to be generally described as "cloth" (and I mean to include plastic films that may be solid without fiber spacings), i.e., fabrics having the appearance of being solid when viewed from a distance, although the fabrics will be seen to have spacings between fibers when held up to the light or when magnified. Lightweight canvas, duck, drill or vinyl material would be suitable, for examples. By "netting" for sidewall portions 34 and for top 21 I mean a material a child can see through and which will readily pass air. One suitable material is plastic "screen wire" such as is used in some tent windows or the like, which is about as dense as would be desirable in order to not interfere too much with vision and to be not much of a bar to air passage, i.e., a breeze. Such plastic screen wire makes a good mosquito netting. By "mosquito netting" obviously I mean any netting with strands too closely spaced to pass mosquitoes. The selection of a netting will depend upon suitability, durability, economy, etc. Plastic "screen wire" made of Nylon would be a good selection.

Figure 5:
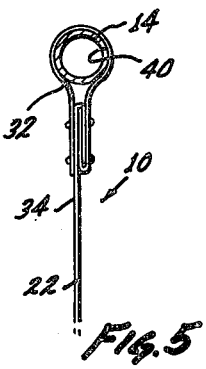
FIG. 5 is a fragmentary view, partly in section, taken on line 5—5 of FIG. 3.
Figure 6:
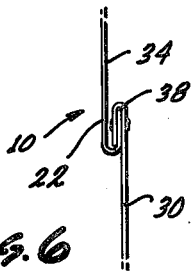
FIG. 6 is a fragmentary view, partly in section, taken on line 6—6 of FIG. 3.
Figure 4:
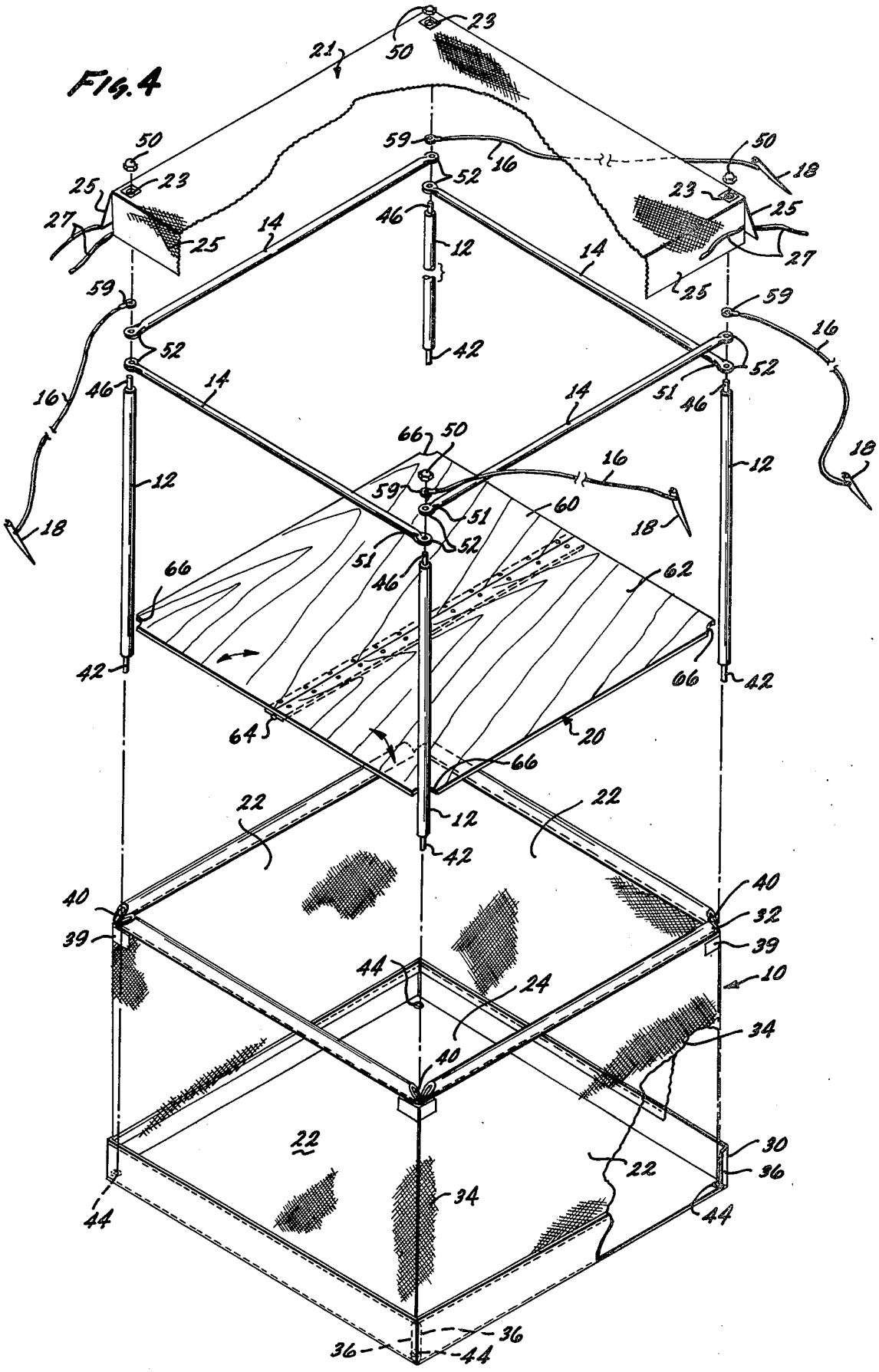
FIG. 4 is an exploded view, in perspective, showing various components of the playpen and indicating the process of raising the playpen.

Bottom wall 24 and the lower portions 30 of side walls 22 can be cut as a single piece, i.e., a square piece of material with cut-out corners which are turned over and stitched as shown at 36 in FIG. 4 and then the two portions viewed sewn together. Top 21 can also be described as a square with cut-out corners. FIG. 6 indicates the securing of lower portions 30 of sidewalls 22 to the netting intermediate section 34 in which portion 30 is folded over the edge of nettings 34 at 38 and sewn. Then portion 38 is sewn flat against section 34. FIG. 5 indicates the securing of upper portions 32 of side walls 22 to the netting intermediate section 34 by folding and stitching, and the provision of a hem 40 in which a horizontal bar 14 is positioned at the top of each side wall 22. A fabric reinforcement 39 is shown at the upper corner areas of netting 34 to prevent tearing. Further details or alternative methods of fabricating fabric member enclosure 10 will be understood.

Posts 12 may be formed of aluminum tubing. The lower ends of posts 12 have ground penetration according to the illustration in order to stabilize those ends. The lower ends could be secured together with bars or secured to floor 20 to stabilize them but the preferred arrangement is with ground penetration. One way to provide a sharp lower end for easy ground penetration is to secure a pointed member 42 in the lower end of each tube 12, i.e., a sharpened metal rod. Pointed rod 42 can be secured in a number of ways, i.e., threaded engagement, crimping, a fastener through the tube and rod, spot welding, rod set in wood dowel set in tube, etc. The function of the pointed lower end 42 of each post 12 is not to support the playpen by ground engagement but rather to secure the lower end against shifting. In raising enclosure 10, it is useful for posts 12 to generally support the structure until other parts are installed but that is the limit of support by post ground penetration. Pointed member 42 passes through a grommet 44 in each corner of bottom wall 24.

The upper ends of posts 12 engage with the ends of horizontal top bars 14. Provision of interengagement is illustrated as including terminal members consisting of a threaded metal stud 46 upstanding from the upper end of each post 12. Stud 46 can be suitably secured in the upper end of the tube by threads, crimping, a fastener through the stud and the tube, spot welding, stud set in a wood dowel set in the tube, etc. A cap or acorn nut 50 is used to secure members on stud 46. Some types of acorn nuts can secure to an unthreaded stud but for repeated usages a threaded assembly is preferable. The use of a cap or acorn nut 50 prevents a standing child from being injured on sharp edges on the end of an exposed stud.

Figure 3:
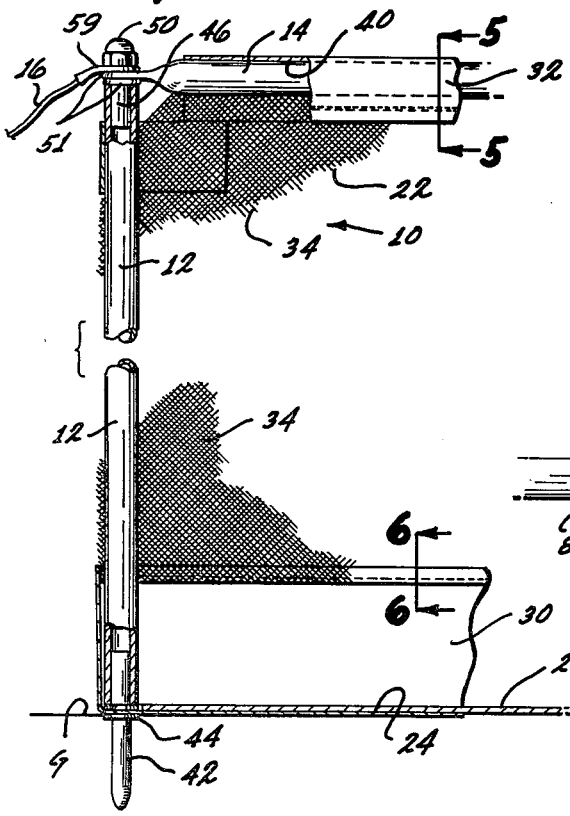
FIG. 3 is a fragmentary, enlarged view, partly in section, taken on line 3—3 of FIG. 1.

Horizontal top bars 14 may be formed of aluminum tubing. The simple method illustrated of securing to posts 12 is to flatten the ends 51 of bars 14 and to drill them thereby providing openings 52 in which studs 46 are positioned, the bars overlapping at their ends 51 in secured position as illustrated in FIG. 3.

Guys 16 extend outwardly from the upper ends of posts 12 and their outer ends are secured as by tying to stakes 18 that are set in the ground at points outlying of enclosure 10. Obviously, stakes 18 should be set at points approximately on a line extending through the nearest and farthest post 12. As the playpen is raised from the ground G, guys 16 are the principal supports of the playpen against tipping of posts 12 other than limited inherent stability of the four posts secured together by bar rails 14 and the stabilization of the lower ends of posts 12 by penetration of the ground G. Guys 16 can be of Nylon cord or other suitable material. A convenient way to secure the inner ends of guys 16 is to fasten the ends in grommets 59 of the type often used for the ends of such flexible members. Tying, as with a slip knot, could be used instead of grommets 59.

A floor 20 is desirable for various reasons, i.e., to avoid heat loss from the child to cool or moist ground, to provide an appropriate surface if the child stands, etc. Floor 20 is shown as being formed by two rigid sections 60, 62 connected together by an aluminum piano hinge 64 riveted or otherwise secured to sections 60, 62. Floor 20 can be formed of 1/4" exterior grade plywood. Its corners 66 are recessed to pass posts 12.

Figure 2:
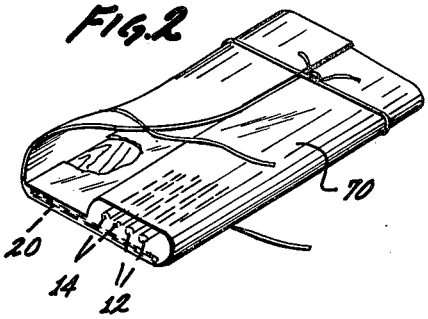
FIG. 2 is a perspective view of a bag containing the playpen in disassembled condition, certain parts of the bag being broken away to show contents.

FIG. 2 show a bag 70 used to store and transport the playpen. In the assembly illustrated, the width and length is determined by the folded sections of floor 20. A suitable dimension for floor 20 is 36 × 36 inches, which would mean that bag 70 can measure about 20 × 39 × 2 inches. With this size floor, each horizontal bar 14 would be close to 36 inches. For posts 12, a 29 inches length, exclusive of members 42, 46, would be suitable. With these floor and post dimensions, about 1⅛ yards of 45 inches wide canvas or the like and about 4 yards of 36 inches wide netting or mesh would be needed to make enclosure 10.

To raise the playpen, enclosure bottom wall 24 would be put on the site selected, posts 12 would be positioned by inserting bottom pointed rods 42 through grommets 44 and forcing them into the ground, bars 14 would be positioned in hems 40 and their end openings 52 installed on metal studs 46 on posts 12. Grommets 59 on guys 16 also would be installed on studs 46, or guys 16 could be tied if grommets 59 are not used. Nuts 50 would be engaged with studs 46. Stakes 18 would be suitably located and the other ends of guys 16 would be tied thereto, which would complete raising of the playpen.

When mosquito netting top 21 is used, its grommets 23 also can be installed on studs 46 under cap-nuts 50 and fabric ties 27 can be tied to secure down depending side-walls 25. An elastic band could be substituted for a pair of ties 27 to connect side-walls 25 without knotting, or the depending side-walls 25 could be sewn together. Top 21 could be formed of closed fabric but mosquito netting is a better selection to pass air on warm days. The playpen could be sold without a top 21 but most users would want a top as mosquitoes, flies or other insects are a problem in most localities.

Figure 7:
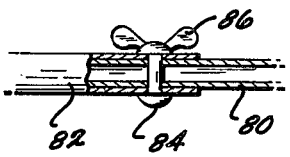
FIG. 7 is a partial view, partly in section, showing joining together of sections of posts or bars.

A considerable portion of the weight of the playpen results from the weight of floor 20. One reason it is preferred that it could be a separate component, i.e., not secured to or integrated with enclosure bottom 24, is so that it can be left behind when parents are going a considerable distance in backpacking and the weight and bulk of floor 20 would be objectionable. In fact, a user only wanting the playpen for backpacking might want to purchase it without floor 20 although a child will be more comfortable and will be better insulated from the ground when floor 20 is used such as in use of the playpen for other than backpacking. For backpacking purposes, the lengths of posts 12 and bars 14 are somewhat unhandy, particularly the posts which are longer. Posts 12 and/or bars 14 can be formed alternatively for backpacking purposes in collapsible form (such as telescoping or folding) or in a form permitting disassembly (such as two parts threaded together). FIG. 7 shows tubing sections 80, 82 (the tubing being either a post or a bar) in which section 80 can telescope within section 82 and in which the parts can be secured together by bolt 84 and wing-nut 86 in extended position. Bolt 84 passes through matching openings in tubes 80, 82. If second openings are provided in tube 80 or tube 82, they could also be secured together in collapsed position.

Having thus described my invention, I do not wish to be understood as limiting myself to the exact details of construction shown. Instead, I wish to cover modifications thereof which will occur to those skilled in the art upon learning of this disclosure and which properly fall within the scope of my invention.

I claim:

1. A portable playpen raised from the ground, comprising:

(a) an enclosure formed of pliable sheet material and having four side walls and a bottom wall in generally right-rectangular disposition and having an open top, at least the vertically intermediate and major portion of said side walls spaced from top and bottom margins being formed of netting so that a playpen occupant can see out through said netting, (b) four upright posts located at the corners formed by adjacent side walls of said enclosure, the upper portion of each post extending at least to a level near to the height of the upper edge of said enclosure, (c) four horizontal top bars, each side wall having its upper margin secured to one of said bars which supports the same, the ends of said bars being secured to said upper portions of said posts, and (d) a guy having one end secured to said upper portion of each post and a stake for each guy set in the ground at a location outlying said enclosure and secured to the other end of the associated guy to support the associated post against tilting inwardly of said enclosure.

2. The subject matter of claim 1 in which there is a top of pliable sheet material on said enclosure bridging between said side walls and closing said top of said enclosure to protect an occupant therein.

3. The subject matter of claim 2 in which said top of pliable sheet material is formed of mosquito netting and in which said netting of said enclosure is mosquito netting.

4. The subject matter of claim 3 in which said top of mosquito netting has grommets in its corners and said posts having upper stud ends which fit in said grommets to secure the same, said bars having end openings also fitting on said stud ends, said top of mosquito netting having depending side walls lapping the upper margins of said enclosure side walls and means securing together adjacent depending side walls at the corners of said enclosure.

5. The subject matter of claim 1 in which there is a folding floor formed of a plurality of rigid sections hingedly connected together and disposed on top of said bottom wall and generally fitting the bottom of said enclosure.

6. The subject matter of claim 1 in which said posts and bars are each divided into at least two sections for reduced length in backpacking, there being means securing each two sections together in extended position for playpen erection.

7. A portable playpen raised from the ground, comprising:

(a) an enclosure formed of pliable sheet material and having four side walls and a bottom wall in generally right-rectangular disposition and having an open top, at least the vertically intermediate and major portion of said side walls being formed of mosquito netting so an occupant can see through said netting, (b) four upright posts located inside said enclosure in the corners between said side walls thereof to support said right-rectangular disposition of said enclosure, said bottom wall having an opening in each corner and the lower end of each post extending through one of said openings and penetrating the ground, the upper portion of each post extending at least to a level near to the height of the upper edge of said enclosure, (c) four horizontal top bars, each side wall having a hem in its upper margin receiving one of said bars which supports the upper portion of the associated side wall, the ends of said bars having openings therein and the upper end of each post being formed with a terminal member which extends through said openings in said ends of two adjacent bars securing the adjacent bars in place, (d) a guy having one end secured to said upper portion of each post and a stake for each guy set in the ground at a location outlying said enclosure and secured to the other end of the associated guy to support the associated post against tilting inwardly of said enclosure, and (e) a mosquito netting top on said enclosure bridging between said side walls and secured at its corners to said posts, said netting top closing said top of said enclosure to protect an occupant against mosquitoes.

8. The subject matter of claim 7 in which said openings in said bottom wall are grommeted, a folding floor having two rigid sections connected by a hinge disposed in said enclosure on top of said bottom wall and generally fitting the bottom of said enclosure, each post being tubular and each terminal member being a stud set in the upper end of the associated post, the lower end of each post being pointed for ground penetration, said bars being tubular, the remainder of said enclosure not formed of netting being formed of closed material including top and bottom portions of said side walls and including said bottom wall, and said netting top having corner grommets engaged with said studs and depending side walls lapping the upper margins of said enclosure side walls and having tie means to secure together adjacent depending side walls at the corners of said enclosure.

* * * * *